United States Patent [19]

Reynolds et al.

[11] 4,166,265

[45] Aug. 28, 1979

[54] COIL BOBBINS AND TERMINATION OF COIL WINDINGS

[75] Inventors: Charles E. Reynolds; Donald W. Hughes, both of Mechanicsburg, Pa.

[73] Assignee: AMP Incorporated, Harrisburg, Pa.

[21] Appl. No.: 874,958

[22] Filed: Feb. 3, 1978

[51] Int. Cl.[2] ..... H01F 15/10

[52] U.S. Cl. ..... 336/192; 29/605; 339/273 R; 339/273 F; 339/276 A

[58] Field of Search ..... 339/276 A, 273 R, 273 F, 339/276 R; 336/192; 310/71; 29/736, 605

[56] References Cited

U.S. PATENT DOCUMENTS

| | | | |
|---|---|---|---|
| 3,011,140 | 11/1961 | Mittenmaier et al. | 336/192 X |
| 3,663,914 | 5/1972 | Lane | 336/192 |
| 4,026,013 | 5/1977 | Hughes | 339/276 R X |
| 4,099,316 | 7/1978 | Morgan | 29/736 X |
| 4,132,913 | 1/1979 | Lautner et al. | 336/192 X |

*Primary Examiner*—Thomas J. Kozma

*Attorney, Agent, or Firm*—Frederick W. Raring

[57] ABSTRACT

A coil bobbin is disclosed which has means for facilitating electrical connections of the coil wire to external conductors. Improved coil winding and manufacturing methods are also disclosed. The coil bobbin has two contact receiving cavities extending into one of its flanges and has integral binding posts for the wire extending from the flange. Wire positioning means are provided for locating the coil wire with its axis extending from the binding posts in crossing relationship to the cavities and then to the coil supporting surface. In use, the wire is wrapped around one of the posts, passed through one of the cavities, and is then wound on the coil supporting surface. After the required number of turns have been wound, the wire is passed through the other cavity and wrapped around the remaining post. Terminals are inserted into the cavities to establish contact with the wire and the posts are cut away from the bobbin flange.

10 Claims, 13 Drawing Figures

COIL BOBBINS AND TERMINATION OF COIL WINDINGS

BACKGROUND OF THE INVENTION

This invention relates to coil bobbins and to methods of manufacturing electrical coils. The invention is herein disclosed with particular reference to the manufacture of relatively small coils having fine wire windings provided with varnish-type insulation however, the principles of the invention are applicable to other types of electrical coils.

It has been common practice in the past in the manufacture of electrical coils to provide metal terminals in the flanges of the coil bobbin and, during winding of the coils, the wire is wrapped around one of the terminal posts, led to the coil supporting surface, and wound on the supporting surface of the bobbin until the coil contains the required number of turns. After winding, the coil wire is wrapped around the remaining post and wire is cut or severed. Thereafter, ends of the coil wire are soldered to the terminal post by simply dipping the posts into a solder bath.

During the past few years, a trend has developed towards the use of contact terminals for coils which do not require soldering but which penetrate the insulation of the coil wire and establish electrical contact with the core thereof. U.S. Pat. Nos. 4,026,013 and 3,979,615 show two types of contact terminals which are being used in the electrical industry for establishing contact with electrical coils. In accordance with the principles of these prior art patents, cavities are provided in the coil support which are dimensioned to receive the terminals and the coil wire is located in these cavities during the winding process. After the winding process has been completed, it is merely necessary to insert terminals into the cavities to establish contact with the ends of the wire. The above identified U.S. patents do not require separate terminal posts on the bobbin as explained above with reference to the commonly known soldering technique for electrical coil wires.

Many of the coil winding processes which are presently being practiced in the electrical industry are carried out by automatic and semi-automatic coil winding machines and these coil winding machines were developed specifically for coil bobbins having terminal posts extending therefrom. Coil winding machines are available which are capable of carrying out all of the operations discussed above, that is, of wrapping the wire around one terminal post, winding the wire around the coil supporting surface, and then wrapping the wire around the remaining terminal post. These coil winding machines are, therefore, not always compatible with the solderless coil wire terminating techniques disclosed in the above identified U.S. Pat. Nos. 4,026,013 and 3,979,615. There is a very large investment in existing coil winding machinery and for this reason it would be uneconomical and impractical for coil manufacturers to convert from solder terminating techniques to the solderless termination processes disclosed in the above identified patents.

The instant invention is directed to the achievement of solderless terminations of coil wires by methods which are fully compatible with coil winding machines of the types which are presently being used in the coil winding industry for solder type terminations. In general, the objects of the invention are achieved by providing a bobbin which has wire binding posts extending therefrom as part of the bobbin molding. The coil bobbin also has terminal receiving cavities in one of its flanges which are located such that the operations of wrapping the coil wire around the first binding post, passing the coil wire through one of the cavities, winding the required number of turns on the coil supporting surface, passing the wire through the second cavity and finally wrapping the wire around the remaining post, can be carried out by a coil winding machine. After these operations have been carried out, terminals can be inserted into the cavities and the binding posts can be cut from the bobbin. Cutting of the binding post also results in cutting of the coil wire adjacent to the fixed ends of the binding posts. The completed bobbin thus contains terminals in its terminal receiving cavities which are connected to the coil wire and which can be connected to the external conductors when the coil is placed in a circuit.

It is accordingly an object of the invention to provide an improved coil support such as a coil bobbin. A further object is to provide improved methods for the manufacture of electrical coils. A further object is the achievement of solderless electrical coils by manufacturing methods which are compatible with a variety of known types of coil winding equipment.

These and other objects of the invention are achieved in preferred embodiments thereof which are briefly described in the foregoing abstract, which are described in detail below, and which are shown in the accompanying drawing in which.

Figure 1:
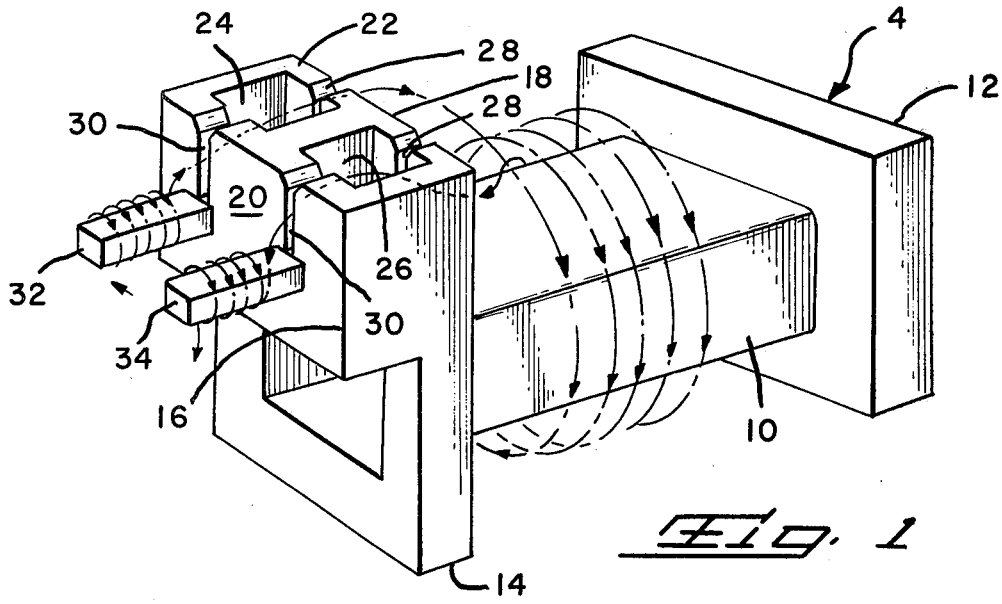
FIG. 1 is a perspective view of one form of coil bobbin in accordance with the invention.
Figure 2:
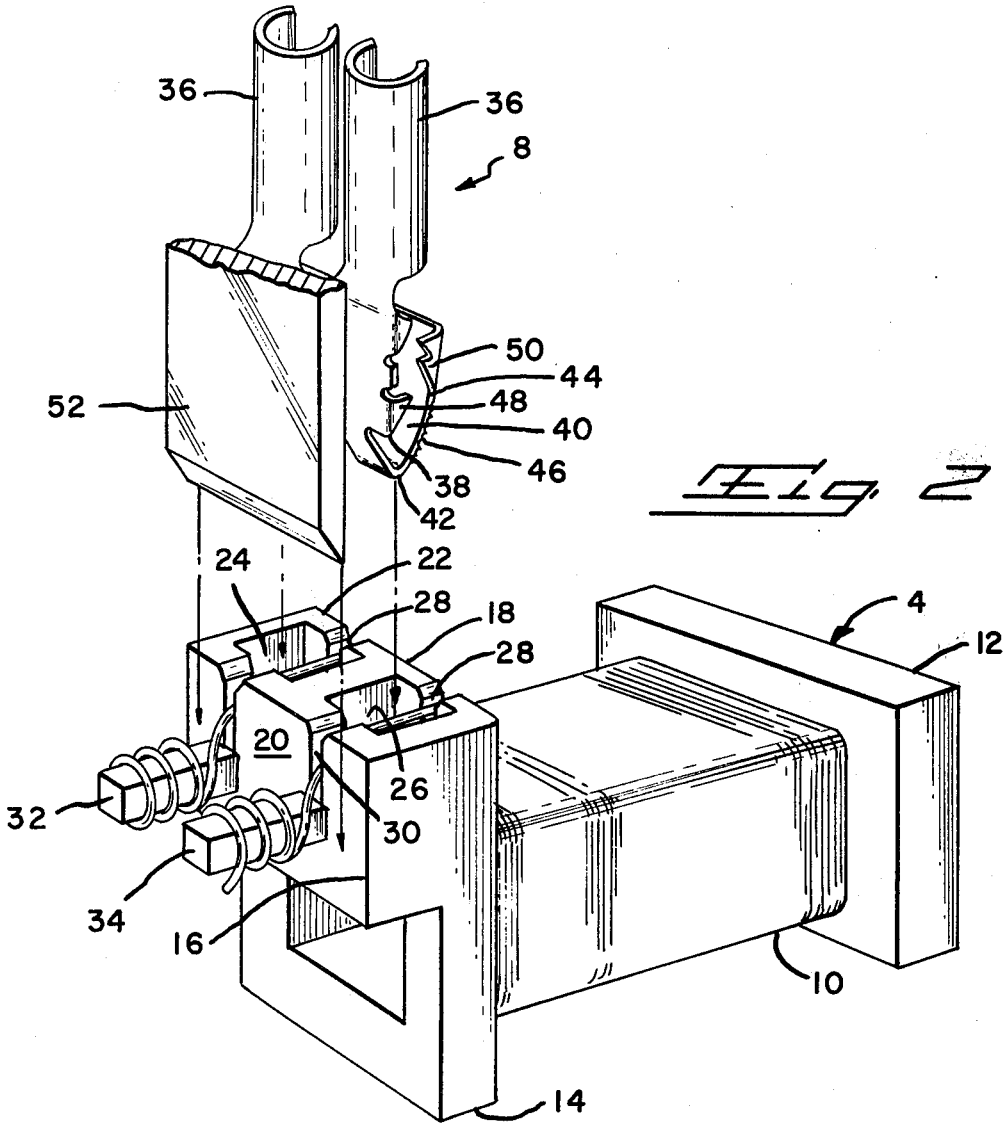
FIG. 2 is a view similar to FIG. 1 but showing the coil wire wound on the bobbin and illustrating the manner of inserting terminals into the cavities of the bobbin and cutting off the wire binding posts.
Figure 3:
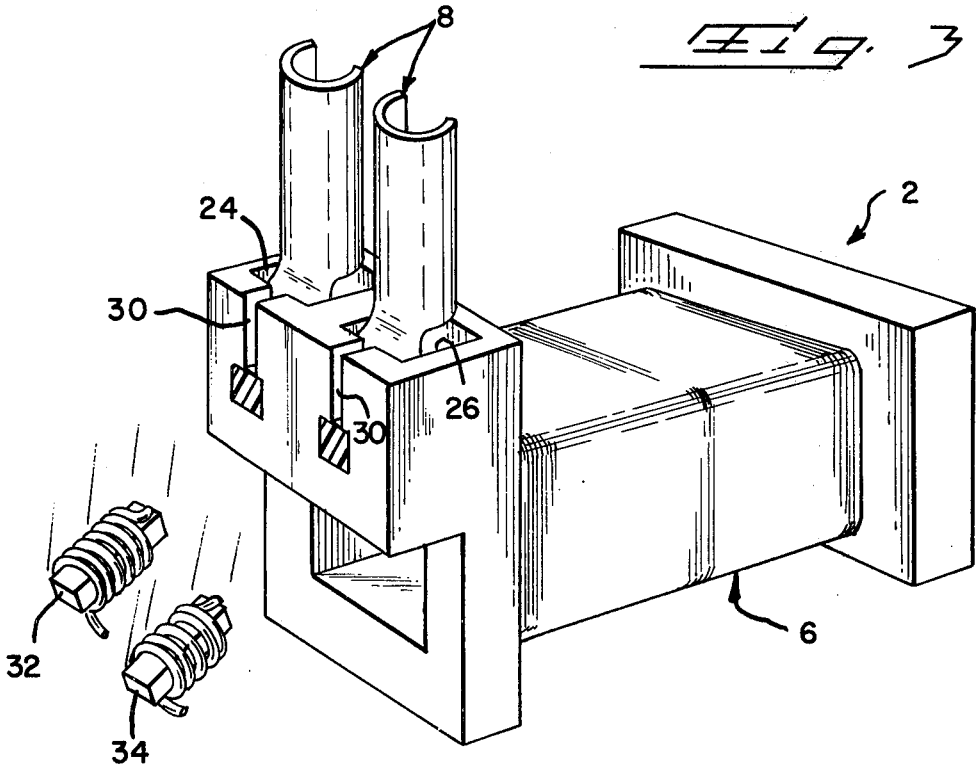
FIG. 3 is a perspective view of the completed coil.

Referring first to the FIGS. 1–3, an electrical coil 2 in accordance with one embodiment of the invention comprises a bobbin 4 having flanges 12, 14 at each end of its coil supporting surface 10. The flange 14 has an enlarged upper portion 16, this enlarged portion having a first surface 18 which is adjacent to coil supporting surface 10 the second surface 20 which is parallel to, and spaced from, surface 18 and a third upwardly facing surface 22 which extends between the first and second surfaces. Two terminal receiving cavities 24, 26 extend inwardly from the surface 22 and slots 28, 30 are provided on the opposed sidewalls of each cavity which are proximate to the surfaces 18, 20 as will be apparent from FIG. 1. These slots are dimensioned to accommodate portions of the coil wire so that the wire can be located in crossing relationship to the cavities. Binding posts 32, 34 extend from the surface 20 adjacent to the lower ends of the slots 30 of each cavity.

Bobbins of the type shown in FIGS. 1–3 are usually manufactured by injection molding of a suitable thermoplastic material such as glass filled nylon material. Advantageously, the material should be such that the binding posts can be severed from the flange 14 during a manufacturing process as will be described below.

In the manufacture of the completed coil assembly 2 the coil wire is first wrapped around the post 32 and then passed through the slot 30, through the cavity 24, and through the slot 28 of the cavity 24. The required number of turns are then wound on the coil supporting surface 10 and after the coil has been wound, the wire is passed through the slot 28 of the cavity 26, across the cavity 26, through the slot 30 and is then wound on the binding post 34.

The electrical connections to the ends of the winding wire are made by inserting terminals 8 (FIG. 2) into each of the terminal receiving cavities 24, 26. Each terminal has an upper receptacle portion 36, which is dimensioned to receive the contact pin on an external conductor, and a conduct portion 38 at its lower end for establishing contact with the coil wire. The contact portion comprises a downwardly extending (as viewed in FIG. 2) web 40 which is reversely bent at 42, to provide upwardly extending contact spring 44. The contact spring has transversely extending serrations 46 on its external surface so that when it is inserted into a cavity, and pressed against one end of a coil wire, these serrations will penetrate the varnish-type insulation of the wire and establish electrical contact. Tangs 48, 50 are provided at the sides of the web portion and on the contact spring for retaining the contact in the cavity. The contact terminal shown may be in accordance with the general principles of the above identified U.S. Pat. No. 4,026,013.

At the time that the contact terminals 8 are inserted into the cavities, a cutting blade 52 is moved downwardly over the surface 20 and the wires are cut adjacent to the fixed ends of the posts 32, 34. Preferably, the posts are also severed from the bobbin flange and drop away as indicated in FIG. 3. It is desirable to cut the ends of the wire immediately prior to engagement of the wire by the contact terminal 8 and to this end, the cutting blade 52 should move in advance of the terminals. The terminals are preferably inserted by an automatic or semi-automatic insertion machine and the cutting blade 52 may be provided on the same machine as taught generally by Application Ser. No. 799,838. As mentioned previously, it is usually preferable to remove the post 32, 34 as indicated in FIG. 3, but if desired the wires can be simply cut by movement of the blade 52 against the posts so that the posts will remain on the bobbin if they are required for any purpose.

It will be apparent that the method steps described above in the manufacture of the coil 2 can be carried out by manual operations or they can be carried out with varying degrees of automation. For example, the wires might be manually wrapped on the posts and the bobbin rotated by a suitable machine during the winding of the coil. A variety of winding machines are available as previously explained and the operations discussed above can be integrated into the operation of the winding machine.

Figure 4:
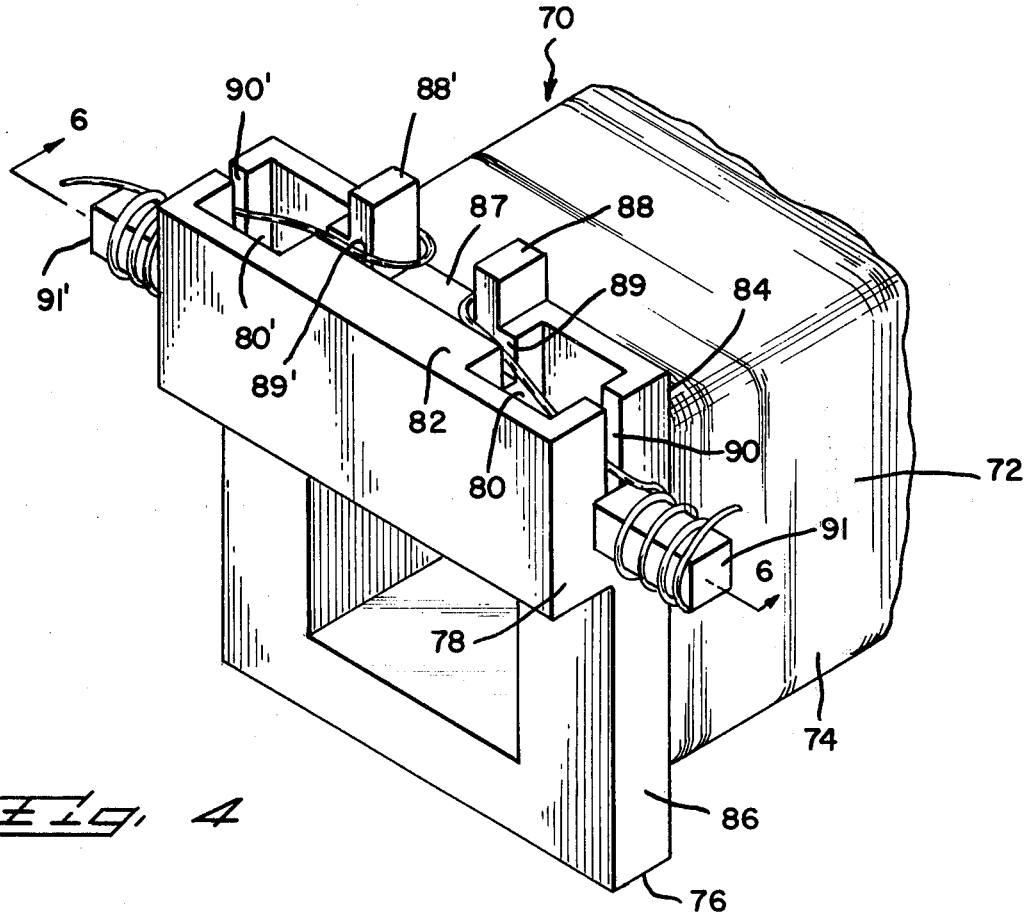
FIG. 4 is a perspective view of an alternative form of bobbin in accordance with the invention having the coil wire wound thereon.
Figure 9:
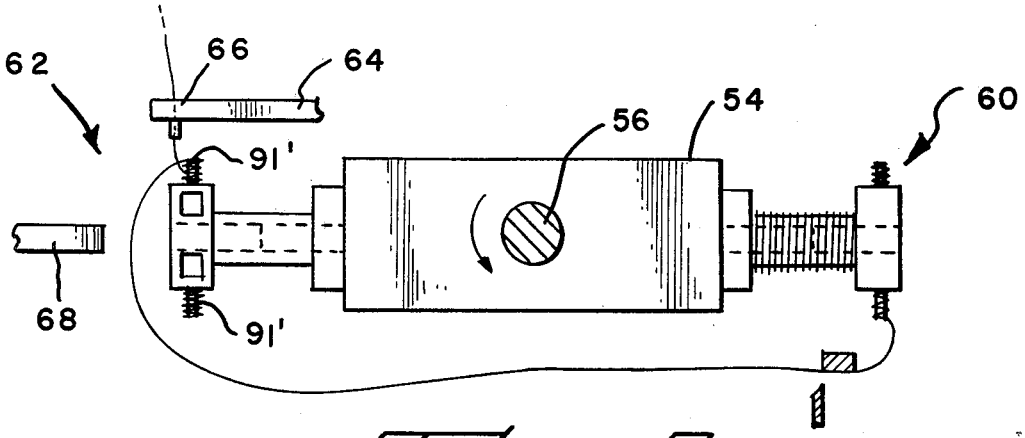
FIG. 9 is a semi-diagrammatic side view showing a portion of a known type of coil winding machine, this view showing the positions of the parts immediately prior to the commencement of a coil winding operation.
Figure 10:
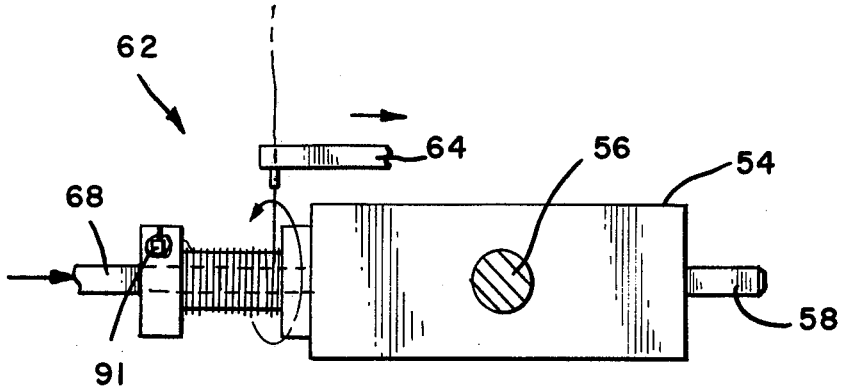
FIGS. 10 and 11 are views similar to FIG. 9 but illustrating the successive steps in the operation of the winding machine.
Figure 11:
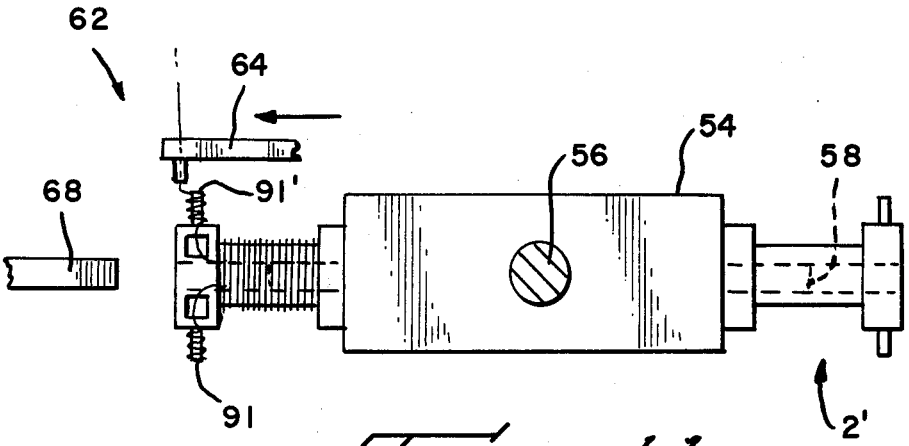

FIG. 4 shows an alternative form of bobbin 70 in accordance with the invention which is particularly intended for use in conjunction with one standard type of bobbin winding machine which is shown in FIGS. 9–11. The bobbin 70 has a coil supporting surface 72 on which the coil 74 is wound and flanges at each end of the surface, one of the flanges being shown at 76. Flange 76 has an enlarged upper portion 78 having an upper terminal-receiving surface 82 into which the cavities 80, 80' extend. The flange also has a surface 84 which is adjacent to the coil and laterally facing side surfaces 86, 86'.

A centrally located recess 87 is provided in the top surface 82 and integral relatively short guide posts 88, 88' extend upwardly on each side of the recess. The recess 87 communicates with the cavities 80, 80' by way of laterally extending slots 89, 89'. Slots 90, 90' are provided in the side surfaces 86, 86' and wire binding posts 91, 91' extend from these side surfaces adjacent to the inner ends of the slots 90,90'.

Figure 7:
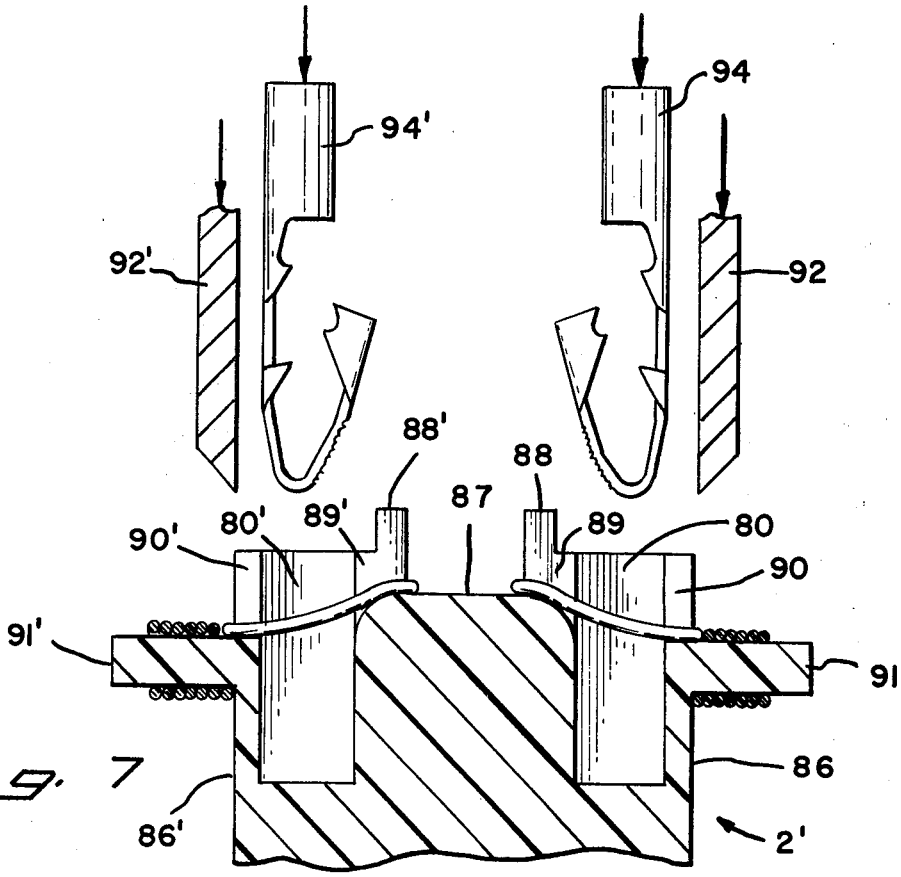
Figure 8:
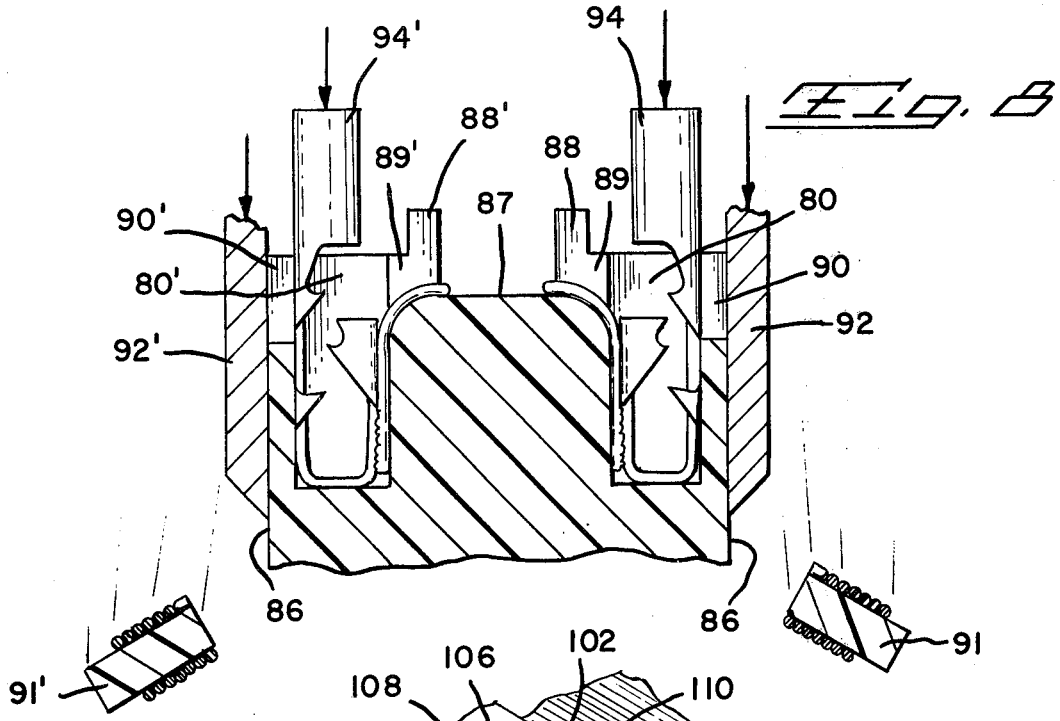

When the coil is wound on the bobbin 70, the wire is first wrapped around the post 91', passed through the slot 90', across the cavity 80', and led around the post 88' as shown. Thereafter, the required number of turns are wound on the coil supporting surface 72. After the turns have been wound on surface 72, the wire is passed across the surface of recess 87, around the guide post 88, through the slot 89, across the cavity 80, through the slot 90, and it is then wound around the post 91. Terminals 94 which may be of the type previously described are then inserted into the cavities as shown in FIG. 7 and cutting blades 92, 92' are moved over the surfaces 86, 86' to cut off the posts and sever the wire. As described previously, the terminals pull the cut ends of the wire into the cavities and establish electrical contact with the wire when the terminal is fully inserted as shown in FIG. 8.

The bobbin shown in FIG. 4 can be used with the type of coil winding machine which is shown diagrammatically in FIGS. 9–11. These figures show one station of a machine which would have a bank of similar stations to permit winding of a plurality of bobbins simultaneously.

The winding machine comprises a central support 54 which can be rotated in the plane of the paper through an angle of 180 degrees with respect to an axis indicated at 56. Coil support arms 58 extend in opposite directions from the support 54 so that one of these arms is always located at the loading station 60 and the other arm will be located at the winding station 62. A wire guide arm 64 is provided at the winding station which has wire guide means 66 at its end for guiding the wire from an endless source, such as a rell, to the bobbin held on the arm 58. Machines of this type under consideration also have a winding mandrel 68 for the bobbin. This winding mandrel is movable from the retracted position of FIG. 9 into the central opening in a bobbin on the arm 58 and is rotatable as shown in FIG. 10 so that the wire can be wound on the bobbin while the arm 64 moves to and fro to distribute the windings evenly over the surface 72.

The arm 64 is also capable of wrapping the wire around the post 91' as shown in FIG. 9 and moving in a manner which will position the wire as shown in FIG. 4 with its axis extending across the cavity 80' and around the post 88' prior to winding of the wire on the bobbin as shown in FIG. 10. It will be understood that these relatively sophisticated winding machines have program control systems for carrying out all of the wrapping, wire positioning and coil winding operations referred to above and described in detail below.

In use, and assuming that the parts are in the position of FIG. 9 with the wire wrapped around the post 91' at the winding station 62, the mandrel 68 first moves into the opening in the bobbin as shown in FIG. 10. Thereafter, the mandrel is caused to rotate through an angle of 90 degrees so that the surface 82 of the bobbin is below the end of the traversing arm 64. The arm 64 then moves along a path which will cause the wire to be laid in the slot 90', in the cavity 80', and around the post 88'. Thereafter, the mandrel rotates at a relatively high speed while the arm 64 traverses to wind the turns on the bobbin. After the required number of turns have been wound on the coil supporting surface, the mandrel is stopped in a position such that the surface 82 is below the arm 64. The arm again positions the wire on the upper surface 84 and in the slot 89 and the mandrel again rotates 90 degrees so that the post 91 is below the arm 64. The arm 64 then wraps the wire around the post 91 as shown in FIG. 11.

The support 54 is then rotated through an angle of 180 degrees to provide an unwound bobbin at the winding station 62 and deliver the wound bobbin to the loading station 60. The operator cuts the wire adjacent to the post 91 of the wound bobbin and removes the bobbin from the arm 58. The terminal inserting operations and cutting operations shown in FIG. 7 can be carried out at a subsequent work station or they can be carried out by mechanisms provided at the loading station 60, if desired.

The general type of winding machine diagrammatically shown in FIGS. 9–11 is produced by Bachi Incorporated of Itasci, Ill. and a typical machine will have many winding stations of the type illustrated in FIGS. 9–11. Machines of this class are extremely sophisticated and provide all of the motions discussed above. Heretofore machines of this class and type have been used to wind coils or bobbins having metallic terminal posts extending therefrom rather than the plastic integral binding posts of the bobbin of FIG. 4. A bobbin of the types shown in FIG. 4 can therefore be substituted for the previously used bobbins having metal terminals extending therefrom, and this substitution can be made without extensive modification of the winding machine. The previously required soldering step can thus be readily replaced by the terminal insertion step and wire trimming step of the present invention.

Figure 12:
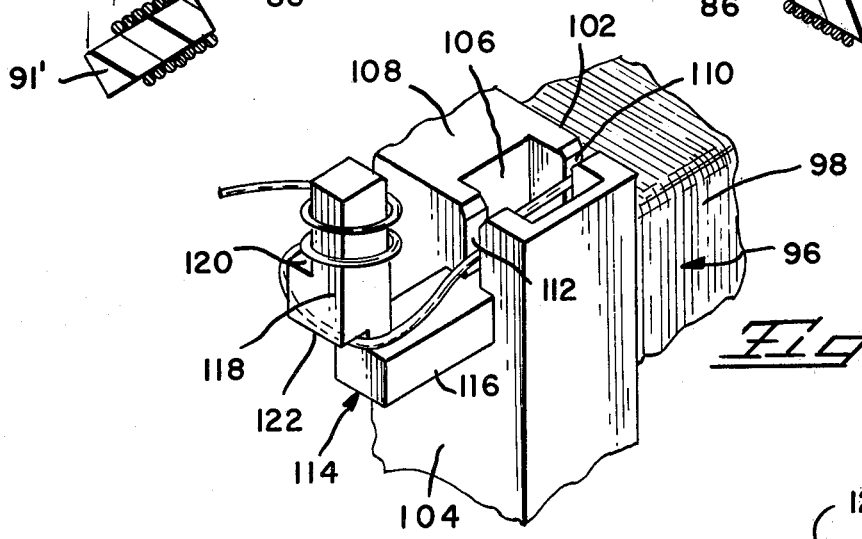
FIG. 12 is a fragmentary view of a portion of a bobbin in accordance with a further embodiment.

FIG. 12 shows a portion of a bobbin 96 in accordance with a further embodiment of the invention. The bobbin 96 has a coil supporting surface 98 and flanges, one of which is shown at 100. The flange 100 has side surfaces 102, 104, the surface 102 being adjacent to the coil supporting surface 98 and the surface 104 facing outwardly from the flange. The terminal receiving cavity 106 extends into the top surface 108 of the flange and wire receiving slots 110, 112, are provided as previously described. The post 114, in this embodiment comprises a first portion arm 116 which extends normally from surface 104 at the inner end of the slot 112 and a vertically extending free arm portion 118 which extends upwardly as viewed in the drawing. An upwardly facing shoulder 120 is provided on the arm 118 and a downwardly facing shoulder 122 is provided on this arm adjacent to the end of the horizontal arm 116.

In use, the wire is wrapped around the vertically extending arm 118 and passed under the shoulder 122. The wire extends from the shoulder 122 along the arm 116, through the cavity 106, and to the wire winding surface or support surface 98. The shoulders 120, 122, serve to stabilize the windings on the post 118 which prevent them from slipping off of the winding post.

It will be understood that at least two cavities 106 and associated winding posts are provided and that after the coil has been wound, the wire is cut and the post 114 is removed as previously described. The embodiment shown in FIG. 12 can be used in conjunction with a coil winding apparatus of the type shown in FIGS. 9–11 since the wire can be wrapped around the vertically extending arm 118 by the traversing arm 64 of the apparatus.

Figure 13:
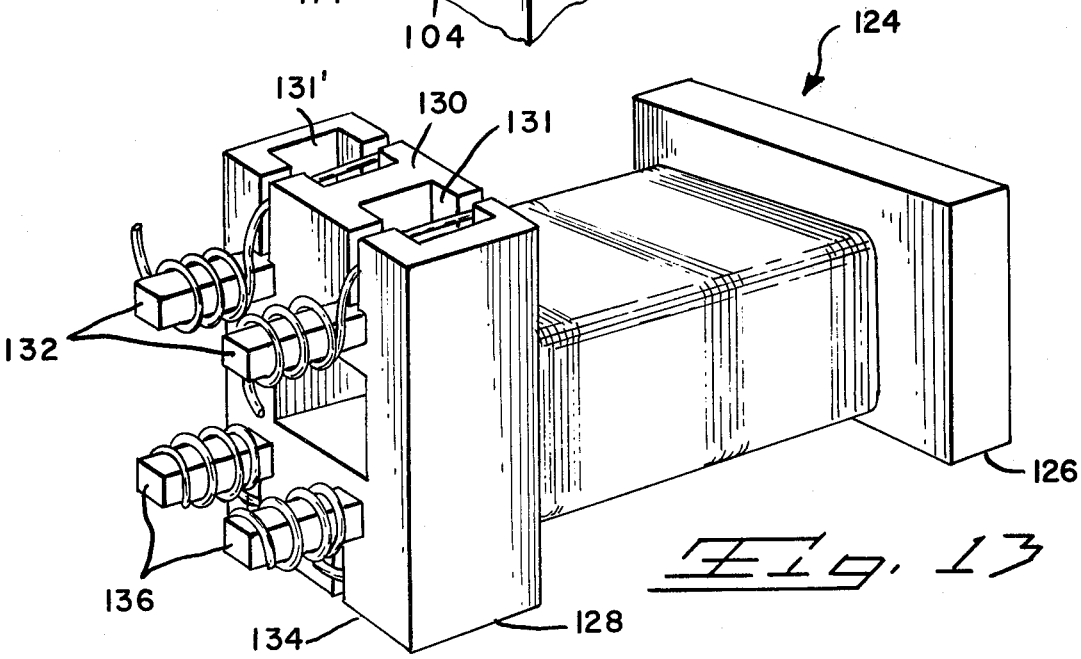
FIG. 13 shows a bobbin of the type shown in FIG. 1, having provision for making tap connections to a coil wound on the bobbin.

The embodiments of the invention described thus far have only two cavities and wire binding posts to permit electrical connection to the ends of the winding wire on the bobbin. Under many circumstances, it is desirable to provide tap connections to the coil at intermediate locations on the winding wire. Tap connections can be provided in accordance with the invention when a bobbin of the general type shown at 124, FIG. 13, is used. This bobbin has flanges 126, 128, at each end of the coil supporting surface and has terminal receiving cavities 131 in the upper surface 130 of the flange 128 and similar cavities extending into the lower surface 134 of the flange. Wire binding posts 132 are provided for the cavities 131 and posts 136 are provided for the cavities extending into the lower surface 134. The principles illustrated by FIG. 13 can be employed to provide tap connections for the other embodiments of the invention discussed above and if desired, terminal receiving cavities can be provided in both of the flanges of the bobbin rather than in only one flange.

It will be apparent that other embodiments of the invention can be devised to satisfy the requirements of a specific coil manufacturing process and/or a specific type of coil winding machine. The principles of the invention can be adopted for a wide range of coil sizes and wire sizes, however, the advantages of the invention are partidularly desirable when the wire size is relatively fine, for example AWG 30 and finer. Extremely fine wires are sometimes difficult to control and an accepted method of securing an extremely fine wire is to take several turns around a post as illustrated and described above.

It will be understood that the specific embodiments of the embodiments of the invention disclosed above are representative of a wide variety of embodiments which might be devised for a specific coil support and a specific type of winding machine. The several types of winding machines have different mechanisms for winding the wire on the coil supporting surface and wrapping the wire around metallic terminal posts and specific embodiments of the instant invention can be devised for many of the winding machines which are now used in the electrical industry. The locations of the terminal receiving cavities in the coil supporting member and the locations of the integral posts relative to these cavities can thus be selected in accordance with the requirements of the winding machine being used. Similarly, where the coil is being wound by the winding machine and termination of the coil wire is being carried out with a manually assisted semi-automatic machine, the terminal receiving cavities and the integral posts such as the posts 132, 136 of FIG. 13, can be located on the coil support in positions which will provide maximum convenience and efficiency.

Figure 5:
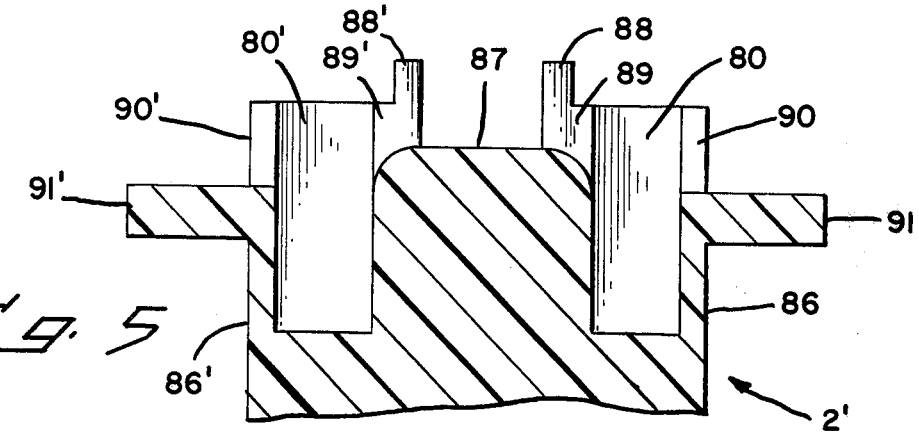
FIGS. 5–8 are sectional views showing the various stages in the manufacture of a coil of the type shown in FIG. 4, these views all being taken along the lines 6—6 of FIG. 4.
Figure 6:
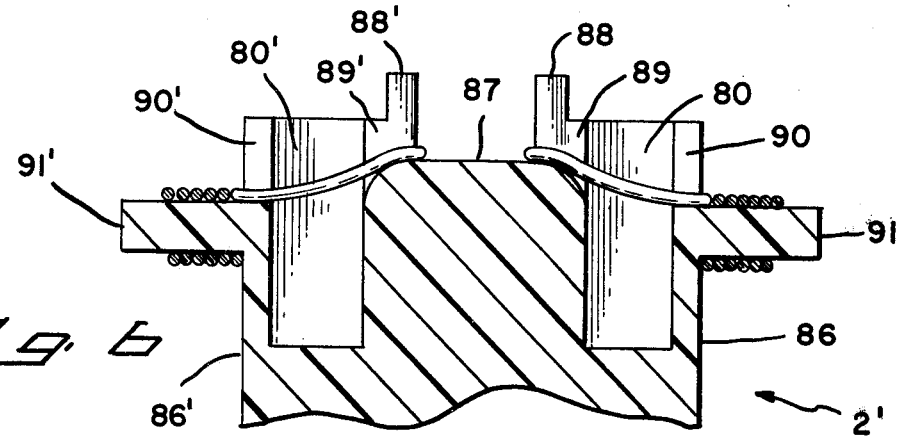

The embodiments of the invention described above all show the type of terminal which is more fully described in the previously identified U.S. Pat. No. 4,026,013 however, the principles of the invention can also be practiced with other types of terminals which are intended to be inserted into a cavity and to establish contact upon insertion with a wire extending across the cavity; for example, with slotted plate-type terminals of the general class disclosed in U.S. Pat. No. 3,979,615. It should be mentioned that the cavities in the coil support will be contoured to receive the specific terminal being inserted and the cavities shown in the accompanying drawing do not have the specific contours and structures required; in other words, the cavities such as the cavities 80, 80', in FIG. 5, are shown diagrammatically in the drawing in the interest of simplicity. Specific details of such cavities are to be found in the above identified U.S. Pat. Nos. 3,979,615 and 4,026,013.

What is claimed is:

1. A molded coil bobbin or the like having improved means for establishing electrical contact with the coil wire, said coil bobbin comprising:

a coil supporting surface which is intended to receive the coil windings, a terminal housing which is integral with said coil supporting surface, said terminal housing having a terminal receiving surface and having a terminal receiving cavity extending inwardly from said terminal receiving surface, first and second wire receiving slots extending into said terminal receiving surface, said first slot extending from said cavity towards said coil supporting surface, said second slot extending from said cavity to a side surface of said housing which is spaced from said coil supporting surface, and, an integral wire binding post extending from said side surface adjacent to said second slot whereby, upon securing a wire to said post, passing said wire through said second slot, through said cavity, and then through said first slot, and then winding said coil around said coil supporting surface, and thereafter inserting a terminal into said cavity and severing said wire by moving a cutting blade against said post, the trimmed end of said wire will be drawn into said cavity by said terminal and said terminal will be electrically connected to said wire.

2. A coil bobbin as set forth in claim 1, said bobbin having flanges at the ends of said coil supporting surface, said cavity extending into one of said flanges.

3. A molded coil support which is intended to have an electrical coil wound thereon, said coil support having improved means for facilitating the connection of the coil wire to an external conductor, said coil support comprising:

a coil supporting surface intended to have said coil wire wound therearound, coil retaining portions extending from said coil supporting surface, said coil retaining portions having a terminal receiving surface which is spaced from said coil supporting surface, a terminal receiving cavity in said coil retaining portions extending inwardly from said terminal receiving surface, an integral wire binding post extending from said coil retaining portions adjacent to said cavity and, wire locating means in said coil retaining portions for locating a coil wire with its axis extending from said binding post in crossing relationship to said cavity and towards said coil supporting surface whereby, upon wrapping a coil wire around said post and locating adjacent portions of said wire in said locating means, said wire will extend towards said coil supporting surface, and after winding said coil, said wire can be trimmed and connected to a terminal by inserting said terminal into said cavity and cutting said coil wire against said post.

4. A coil support as set forth in claim 3, said coil support comprising a coil bobbin, said coil retaining portions comprising flanges extending from the ends of said coil supporting surface.

5. A coil support as set forth in claim 4, said terminal receiving surface being on at least one of said flanges and extending generally parallel to portions of said coil supporting surface.

6. A coil support as set forth in claim 3, said coil support comprising a coil bobbin having flanges at each end of said coil supporting surface, one of said flanges having a first surface which extends normally from, and is adjacent to, said coil supporting surface, said terminal receiving surface comprising surface portions of said one flange which adjoin said first surface, said post extending from said surface portions which adjoin said first surface.

7. A coil support as set forth in claim 3, said coil support comprising a coil bobbin having flanges at each end of coil supporting surface, one of said flanges having a first surface which extends normally from said coil supporting surface, a second surface which is generally parallel to and spaced from said first surface, said terminal receiving surface extending between said first and second surfaces, said post extending from said second surface.

8. A coil support which is intended to have an electrical coil wound thereon, said coil support having improved means for facilitating the connection of the coil wire to external conductors, said coil support comprising:

coil supporting surface means intended to have said coil wound therearound, coil retaining means extending from said coil supporting surface means, said coil retaining means having a first surface which is adjacent to, and extends from, said coil supporting surface, a second surface which is generally parallel to and spaced from, said first surface, and a terminal receiving surface which is spaced from said coil supporting surface and which extends between said first and second surfaces, at least one terminal receiving cavity extending into said coil retaining means from said terminal-receiving surface, first and second wire-receiving slots extending into said terminal receiving surface, said first wire-receiving slot opening onto said first surface and opening into said cavity, said second wire-receiving slot opening into said cavity and onto said second surface and, a severable post extending from said second surface adjacent to said slot means, said post being spaced from said terminal receiving surface whereby, upon securing a wire to said post, passing said wire through said second slot, through said cavity, and then through said first slot, and then winding said coil around said coil supporting surface, and thereafter inserting a terminal into said cavity and severing said post and said wire at a location between said first and said second slot, said wire will be connected to said terminal in said cavity.

9. A coil support as set forth in claim 8, said coil support comprising a coil bobbin, said coil retaining means comprising flanges at the ends of said coil supporting surface.

10. A coil support as set forth in claim 9, having at least one additional terminal receiving cavity, one additional first wire receiving slot, one additional second wire receiving slot, and one additional post.

* * * * *